US005217169A

United States Patent [19]

Faulkner, III et al.

[11] Patent Number: 5,217,169

[45] Date of Patent: Jun. 8, 1993

[54] DROOL-RETARDING VALVING OF A MULTI NOZZLE ADHESIVE MANIFOLD

[75] Inventors: W. Harrison Faulkner, III; Douglas E. Colton, both of Salinas; Neil L. Sarasohn, Aptos, all of Calif.

[73] Assignee: Slautterback Corporation, Monterey, Calif.

[21] Appl. No.: 726,982

[22] Filed: Jul. 8, 1991

[51] Int. Cl.[5] ..... B05B 1/30

[52] U.S. Cl. ..... 239/562; 239/570; 239/583; 239/586; 137/871; 137/881

[58] Field of Search ..... 239/104, 120, 562, 570, 239/583, 586, 585.1–585.5; 137/614.2, 881, 871, 509

[56] References Cited

U.S. PATENT DOCUMENTS

| | | | |
|---|---|---|---|
| 2,630,324 | 3/1953 | Lay | 239/562 |
| 3,174,689 | 3/1965 | McIntyre | 239/583 |
| 3,494,482 | 2/1969 | Nord et al. | 239/583 |
| 3,724,492 | 4/1973 | Itter | 239/562 |
| 4,124,163 | 11/1978 | Siegmann | 239/570 |
| 4,231,520 | 11/1980 | Waldrum | 239/562 |
| 4,289,167 | 9/1981 | Switall | 239/562 |
| 4,602,741 | 7/1986 | Faulkner, III et al. | 239/135 |
| 4,659,016 | 4/1987 | Faulkner, III | 239/135 |
| 4,768,718 | 9/1988 | Faulkner, III | 239/410 |
| 4,958,773 | 9/1990 | Stettner et al. | 239/585.3 |
| 4,983,109 | 1/1991 | Miller et al. | 425/7 |

FOREIGN PATENT DOCUMENTS

| | | | |
|---|---|---|---|
| 0041464 | 3/1982 | Japan | 239/585.5 |
| 352108 | 7/1931 | United Kingdom | 239/104 |

*Primary Examiner*—Andres Kashnikow
*Assistant Examiner*—Karen B. Merritt
*Attorney, Agent, or Firm*—Schneck & McHugh

[57] ABSTRACT

A device for retarding drool from a multi nozzle manifold having a plurality of outlet passageways in fluid communication with a single feed passageway. A drool-retarding member selectively segregates the outlet passageways with respect to fluid communication among the outlet passageways, preventing flow from one outlet passageway into a lower outlet passageway during adhesive cutoff periods. The drool-retarding member is a reciprocating member having an inoperative position in which a plurality of inlet ports to the outlet passageways are sealed, and having a fluid-apply position in which the inlet ports are free to allow fluid communication among the outlet passageways and the feed passageway. In a passive embodiment, the drool-retarding member is a valve that is spring biased to cover the inlet ports. Pressurized adhesive overcomes the bias of the spring when an upstream flow-regulating mechanism is controlled to discontinue adhesive flow. In an active embodiment, the drool-retarding member is a solenoid armature that is the flow-regulating mechanism.

13 Claims, 4 Drawing Sheets

DROOL-RETARDING VALVING OF A MULTI NOZZLE ADHESIVE MANIFOLD

DESCRIPTION

1. Technical Field

The present invention relates generally to devices for dispensing viscous fluid materials and more particularly to apparatus for applying hot-melt adhesive and the like.

2. Background Art

Hot-melt adhesives are used extensively for case and carton sealing on automated packaging machinery. U.S. Pat. No. 4,602,741 to Faulkner, III et al. teaches a dispensing device having a T-shaped nozzle assembly for applying adhesive to flaps at the top of a carton and having a Y-shaped nozzle assembly for applying adhesive to flaps at the bottom of the carton.

Nozzles on a T-shaped nozzle assembly are positioned along a common horizontal plane. In comparison, the nozzles on a Y-shaped assembly vary in height. The lowermost nozzle has a greater tendency to drool between applications, since gravitational force pulls adhesive downwardly along the column of adhesive that joins the various nozzles. The patent to Faulkner, III et al. teaches use of a low pressure applicator with large diameter nozzles to reduce the risk of drips, drools or leaks from nozzle tips during adhesive cutoff periods.

Reducing drool is a concern in the design of adhesive applicators of any configuration. U.S. Pat. No. 4,768,718 to Faulkner, III teaches a nozzle assembly in which nozzles are arranged vertically and are aimed to direct adhesive horizontally. Each nozzle is equipped with a check valve having an axial bore for the passage of air and having a flared shoulder that is spring biased to block adhesive flow during cutoff periods. A check valve at each nozzle of an array of nozzles provides a number of advantages. Because the check valves are located at the nozzle outlets, only a small portion of material is exposed to the ambient atmosphere. Therefore, the material is less likely to undergo cooling. However, the check valves increase the number of working parts located along an adhesive flow path. This may have an effect on the time in which a nozzle assembly is to operate between scheduled preventive maintenance shutdowns. Charred adhesive can collect in springs and in other working parts.

It is an object of the present invention to provide a device for applying viscous fluid material, wherein the device reduces the risk of drooling between applications in a manner that does not significantly increase the number of operating components that can be adversely affected by charred material or other particles within the flow of viscous fluid material.

SUMMARY OF THE INVENTION

The above object has been met by a device for applying viscous fluid material, typically adhesive, from a plurality of outlet passageways to a corresponding number of nozzles, with a reciprocating member that seals each outlet passageway relative to the remaining outlet passageways during adhesive cutoff periods. A particular outlet passageway remains in communication with the atmosphere at the nozzle end, but cannot combine with a second outlet passageway to provide a second opening to the atmosphere. Any tendency to drool caused by gravitational force on a column of adhesive in the outlet passageway is overcome by vacuum force that is created by movement of the column.

In one embodiment, the outlet passageways are individually sealed by a spring-biased valve member that is downstream of the on-off control of viscous fluid material flow. The adhesive is received at a feed passageway of a manifold. The feed passageway includes a plurality of adhesive-receiving inlets to the outlet passageways. A pressurized flow of adhesive overcomes the bias of the spring on the valve member to allow free communication between the feed passageway and the various outlet passageways to the nozzles. However, discontinuance of pressurized flow causes the valve member to move to a seated position. That is, the valve member is biased into an inoperative position. In this position a shoulder of the valve member comes into contact with each of the adhesive-receiving inlets. The inlets are sealed from the feed passageway of the manifold, but this is not of primary concern. More importantly, the outlet passageways are sealed relative to each other. Consequently, the tendency of two outlet passageways to cooperate to provide a path open at both ends to the atmosphere is defeated. Instead, the upstream end of each outlet passageway is sealed in a manner that retards dripping or drooling from the associated nozzle. Preferably, the spring is positioned outside of the path of adhesive flow.

In a second embodiment, the reciprocating member is an armature of a solenoid. Typically, in this embodiment the armature is the means of preventing fluid flow from the feed passageway, as well as the means of preventing fluid communication between outlet passageways during adhesive cutoff periods. The reciprocating armature has a geometry corresponding to the geometry of a valve seat. The adhesive-receiving inlets are arranged within the valve seat. In one position the reciprocating armature blocks the flow of adhesive from the feed passageway into the outlet passageways and precludes flow of adhesive from an upper outlet passageway to a lower outlet passageway. In a fluid-apply position, the reciprocating armature is positioned away from the outlet passageways. Preferably, the reciprocating armature is a magnetically-controlled member positioned within the feed passageway, but this is not critical.

An advantage of the present invention is that by sealing the adhesive-receiving inlets of the outlet passageways, air pressure no longer urges the flow of adhesive from nozzles during cutoff periods of a dispensing device. Thus, the tendency of a device to drip or drool is reduced. Another advantage is that the control of drool is provided without significantly increasing the number of working parts in the dispensing device.

BEST MODE FOR CARRYING OUT THE INVENTION

Figure 1:
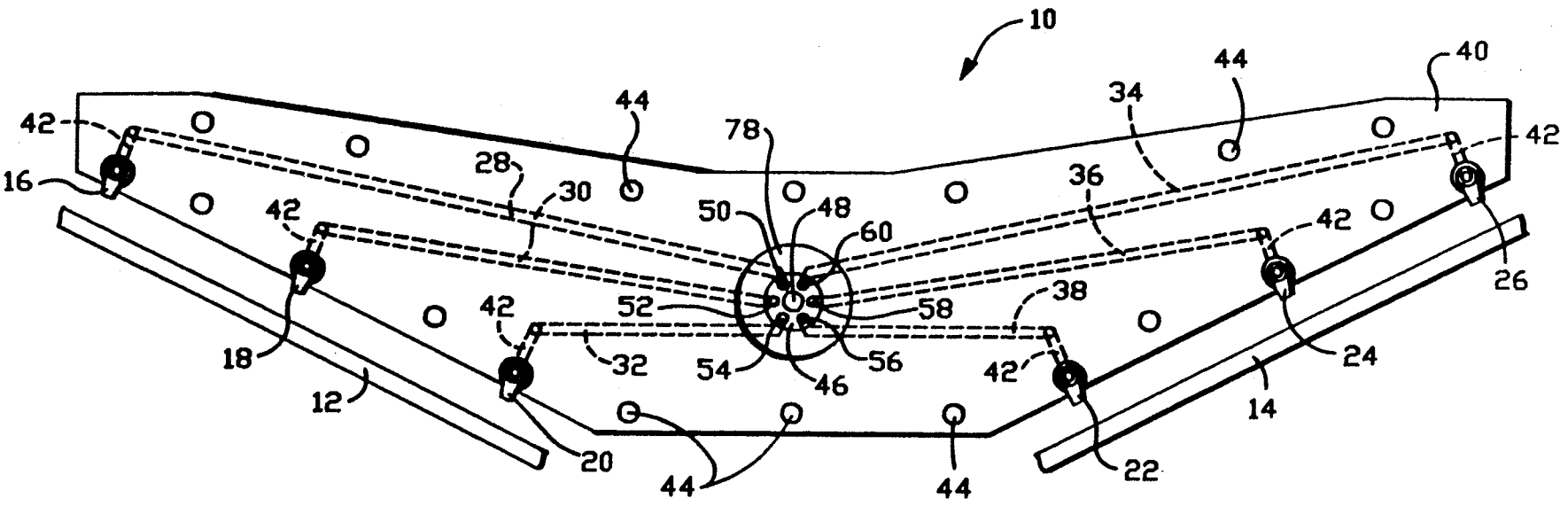
FIG. 1 is a front view of a manifold of a dispensing device in accord with the present invention.

With reference to FIG. 1, a manifold 10 is shown for applying adhesive to first and second flaps 12 and 14 of a carton. The manifold 10 is typically used for the sealing of carton flaps on an automated assembly line, with the flaps 12 and 14 being located at the bottom side of the carton. The flaps 12 and 14 extend downwardly from the carton, with the center of the carton traveling over the center of the manifold. After the carton has cleared the manifold, the flaps 12 and 14 are pivoted upwardly to contact minor flaps on the carton, thereby sealing the carton bottom. A second manifold is used to seal flaps at the top of the carton.

Six nozzles 16, 18, 20, 22, 24 and 26 are shown as being aimed at the flaps 12 and 14. U.S. Pat. No. 4,659,016 to Faulkner, III, assigned to the assignee of the present application, teaches aimable nozzles 16–26 and a solenoid assembly for use with the manifold 10. That patent is incorporated by reference herein.

The manifold 10 includes outlet passageways 28, 30, 32, 34, 36 and 38 that correspond in number to the nozzles 16–26. For ease of manufacture the manifold 10 includes a forward nozzle bar 40 and a faceplate, not shown. The outlet passageways 28–38 are semicircular grooves that are cut into the rear surface of the nozzle bar 40. At nozzle ends of the outlet passageways, bores 42 that are drilled at a 30° angle to the outlet passageways. The bores 42 provide fluid communication between the outlet passageways and the nozzles 16–26. When the nozzle bar 40 is fastened against the faceplate, the combination of the two members provides a leakproof path along the outlet passageways to the bores 42 and the associated nozzles. The nozzle bar is secured to the faceplate by bolts which pass through an array of bores 44 in the nozzle bar.

In the center of the manifold 10 is a valve seat 46. A feed passageway 48 is in fluid communication with a source of adhesive, not shown. The flow of adhesive is controlled in a manner well known in the art to intermittently channel pressurized adhesive to the feed passageway 48. The timing of the pressurized flow is a function of the speed of carton movement on an automated assembly line.

The valve seat 46 includes an array of inlet ports 50, 52, 54, 56, 58 and 60 that channel the flow of pressurized adhesive from the feed passageway 48 to the six outlet passageways 28–38. That is, the inlet ports are adhesive-receiving openings at the valve seat 46. Thus, each of the outlet passageways 28–38 is in fluid communication with the feed passageway 48 and the remaining outlet passageways.

An important concern in the design of a multi nozzle manifold 10 is minimizing dripping and drooling between adhesive applications. Manifolds such as that shown in FIG. 1 are particularly susceptible to dripping and drooling, since the nozzles 16–26 vary in height. For example, where the feed passageway 32 of a lowermost nozzle 20 is in fluid communication with the feed passageway 34 of an upper nozzle 26, a column of adhesive in the upper outlet passageway 34 will be pulled by gravitational force toward the lowermost nozzle 20. As a result, if left unchecked, the nozzles 20 and 22 will have a tendency to drool between applications.

The present invention overcomes this tendency to drool from the lower nozzles 20 and 22 by sealing each of the outlet passageways 28–38 during adhesive cutoff periods. In a first embodiment to be described below, sealing of the outlet passageways is downstream of the control mechanism that regulates flow of pressurized adhesive through the feed passageway 48. In a second embodiment, the control mechanism itself is used in sealing the feed passageways. In either situation, the ability of one outlet passageway to effect drooling from a second outlet passageway is eliminated. By sealing each outlet passageway at its inlet port 50–60, the outlet passageways are in communication with the atmosphere only at nozzle ends. Therefore, any undesired flow in an outlet passageway during an adhesive cutoff period requires generating vacuum pressure at the tail end of the undesired flow. The vacuum pressure tends to prevent drool from the associated nozzle 16–26.

Figure 2:
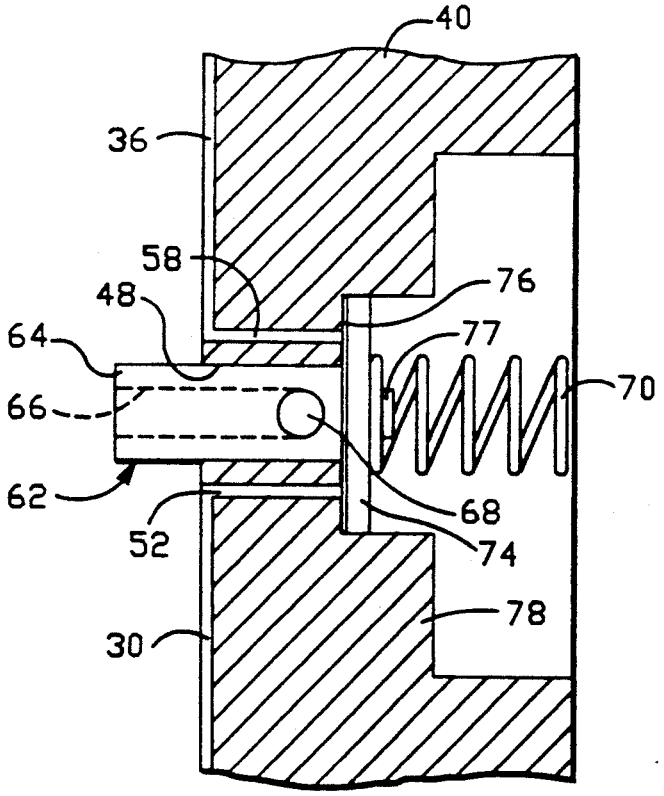
FIG. 2 is a top sectional view of a valve member to be used with the manifold of FIG. 1, wherein the valve member is shown in an inoperative position.

Referring now to FIG. 2, a top sectional view of the nozzle bar 40 illustrates a pair of the outlet passageways 30 and 36. As noted above, the outlet passageways are semicircular grooves cut into the nozzle bar so that fastening the nozzle bar against a planar surface of a faceplate, not shown, provides a leakproof path for adhesive flow.

A valve member 62 is shown as being slidably fit within the feed passageway 48 of the nozzle bar 40. The valve member includes a stem portion 64 having an axial bore 66. The axial bore 66 receives pressurized adhesive for exit through an outlet channel 68 that is perpendicular to the axis of the valve member 62. In the position shown in FIG. 2, the outlet channel is contained within the feed passageway 48. In this position the structure of the nozzle bar 40 prevents exit of adhesive from the outlet channel. A coil spring 70 biases the valve member 62 into the position shown in FIG. 2.

Figure 3:
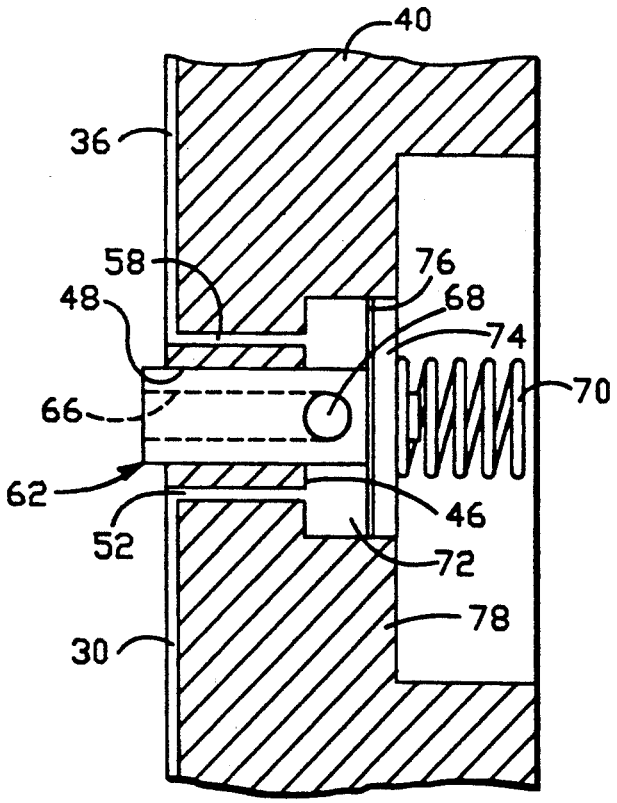
FIG. 3 is a top sectional view of the valve member of FIG. 2 shown in a fluid-apply position.

The valve member 62 is shown in an inoperative position in FIG. 2. The coil spring 70 exerts sufficient force to maintain the valve member 62 in this inoperative position when an upstream control mechanism has discontinued flow of pressurized adhesive to the feed passageway 48. However, initiation of pressurized flow to the feed passageway overcomes the bias of the coil spring 70. As shown in FIG. 3, a flow of pressurized adhesive exerts a force on the valve member 62 and compresses the coil spring 70. The fluid-apply position of the valve member shown in FIG. 3 places the outlet channel 68 of the valve member 62 beyond the valve seat 46. The pressurized flow of adhesive exits from the outlet channel 68 and enters the inlet ports 52 and 58. From the inlet ports the adhesive is able to flow freely into the outlet passageways 30 and 36 for extrusion from associated nozzles. Preferably, the nozzle bar 40 includes a stop, not shown, that restricts movement of the valve member 62 to the recessed area of the valve seat 46.

Comparing FIGS. 2 and 3, in the fluid-apply position the outlet channel 68 is moved from a first condition in which adhesive flow is blocked from exiting from the axial bore 66 into a second condition in which a chamber 72 is formed to receive pressurized flow from the outlet channel 68. However, because the valve member is downstream of the flow control mechanism, this is not the primary function of the valve member 62. Rather, the primary function is to seal each of the outlet passageways 30 and 36 relative to the remaining outlet passageways. This is illustrated in FIG. 2. The valve member 62 has a shoulder 74 which is a cylindrical portion of the valve member. The shoulder has a radius greater than the radial extent of the inlet ports 52 and 58. Therefore, in the inoperative position of FIG. 2 the coil spring 70 presses the shoulder 74 into blocking relation with the inlet ports. At the rearward surface of the shoulder 74 is a coating 76 of synthetic resin polymer sold under the trademark Teflon. The coating 76 is not critical. At the forward surface of the shoulder 74 is a nipple 77 that is used to maintain the coil spring 70 in position. A cap, not shown, is inserted into the nozzle bar 40 and is fastened against a surface 78 to provide structure against which the coil spring 70 is maintained.

In operation, as shown in FIGS. 1 and 3, pressurized adhesive flowing into the feed passageway 48 exerts a force which overcomes the bias of the coil spring 70. The valve member 62 is displaced to a position in which the pressurized adhesive flows through the axial bore 66 and outlet channel 68 to a chamber 72. From the chamber, the pressurized adhesive enters each of the inlet ports 50–60. From the pressurized ports the adhesive travels through the outlet passageways 28–38 for extrusion from the nozzles 16–26.

Discontinuance of the flow of pressurized adhesive allows the coil spring 70 to press the valve member 62 into the inoperative position shown in FIG. 2. In this position, the inlet ports 50–60 are sealed relative to each other. Therefore, any gravitational force on a column of adhesive in an upper outlet passageway 34 of FIG. 1 will generate pressure at the valve member, but will not initiate flow from the upper outlet passageway 34 to a lower outlet passageway 32. The only escape of a column of adhesive within an outlet passageway 28–38 is via the nozzle 16–26 associated with the outlet passageway. However, the outlet passageways are either horizontal or are sloped upwardly to minimize gravitational feed to an associated nozzle. Moreover, because the flow to a nozzle during an adhesive cutoff period would require formation of a vacuum at the tail end of the flow, dripping and drooling is minimized.

Figure 4:
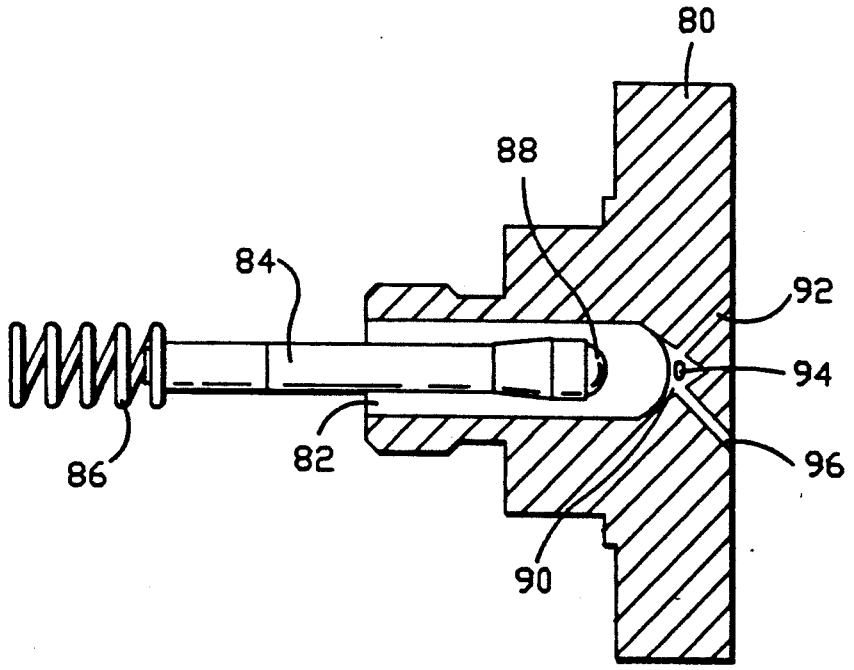
FIG. 4 is a top sectional view of a solenoid-actuated armature for use with the manifold of FIG. 1.

The embodiment of FIGS. 2 and 3 is referred to as a passive valving, since it is a spring which causes movement of a valve member. An active valve is shown in the embodiment of FIG. 4. FIG. 4 illustrates a faceplate 80 that can be used with a nozzle bar 40 similar to the one shown in FIG. 1. The faceplate includes a feed passageway 82 which receives a pressurized flow of adhesive. Within the feed passageway is a solenoid armature 84. The solenoid armature is operationally identical to the armatures described in each of the above-identified patents to Faulkner, III.

The solenoid armature 84 is maintained in the position shown in FIG. 4 by energization of a solenoid coil, not shown. Optionally, the armature can be controlled by a pneumatic or hydraulic solenoid. Energization of the solenoid overcomes the bias of a spring 86.

De-energization of the solenoid permits the coil spring 86 to displace the solenoid armature 84 forwardly. A crimp ball 88 at a forward end of the solenoid armature has a geometry corresponding to the geometry of a valve seat 90 of the faceplate 80. When pressed forwardly by the coil spring, the crimp ball seals each of a plurality of adhesive-receiving ports 92, 94 and 96. As in the above-described embodiment, the adhesive-receiving ports 92–96 are sealed from each other. Therefore, adhesive in an upper port 92 and in an outlet passageway associated with the upper port is not pulled by gravity into a lower adhesive-receiving port 96.

The faceplate 80 is fastened to a nozzle bar, not shown, having outlet passageways to nozzles. Again, the nozzle bar has semicircular grooves cut into the surface that abuts the faceplate. Fabrication of a nozzle bar having semicircular grooves in a rear surface more easily allows turns in the passageway, as compared to drilling bores into a nozzle manifold.

Figure 5:
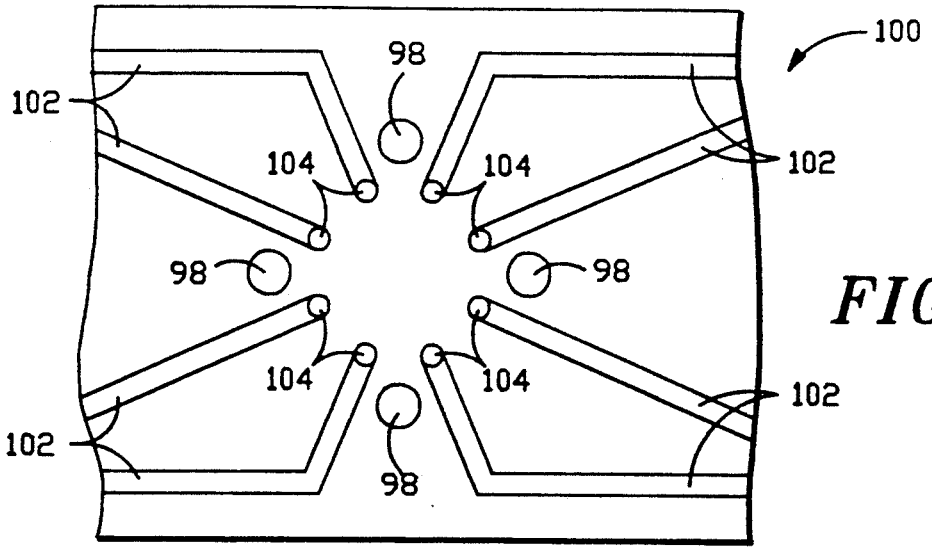
FIGS. 5–7 illustrate alternative arrangements of outlet passageways for the manifold of FIG. 1.
Figure 6:
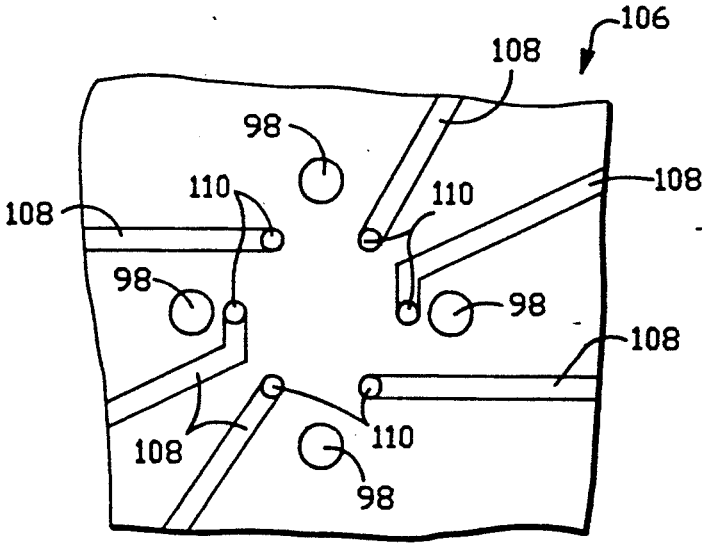
Figure 7:
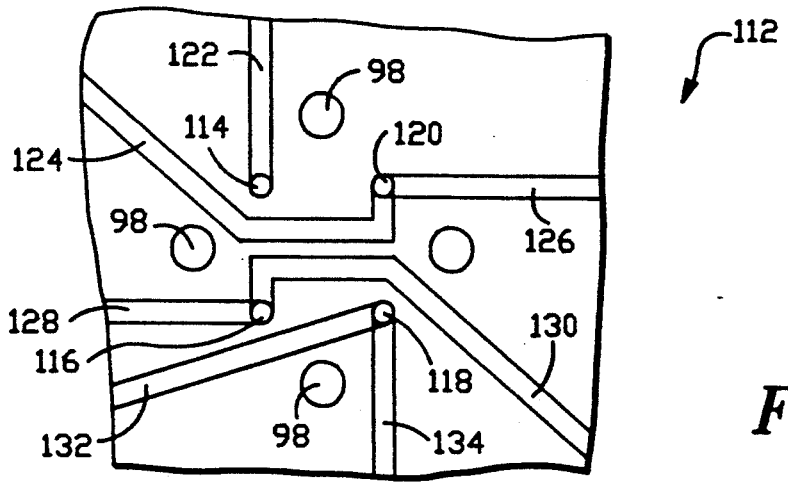

Referring now to FIGS. 5–7, various embodiments of a valve seat are shown. Each valve seat includes internally-threaded bores 98 that allow fastening of a valving assembly to the valve seat. In the use of the valve member 62 of FIGS. 2 and 3, the internally-threaded bores 98 of FIGS. 5–7 would be arranged along the surface 78.

The valve seat 100 of FIG. 5 includes eight outlet passageways 102 that terminate at inlet ports 104 at radial inward ends and terminate at nozzles at opposite ends, not shown. The number of outlet passageways and nozzles is dependent upon the desired use of the adhesive applicator. The feed passageway is not shown in FIGS. 5–7. Typically, the feed passageway is to the center of the valve seat.

The valve seat 106 of FIG. 6 includes a total of six outlet passageways 108 connected to inlet ports 110. In general, portions of inlet passageways that have a downward component of direction preferably are kept at a minimum length. Passageways in which downwardly extending portions are long or are steep are particularly susceptible to adhesive drool from an associated nozzle. However, FIG. 6 illustrates outlet passageways in which a downward slope is steep. Consequently, sealing of the inlet ports 110 is of increased importance.

In the valve seat 112 of FIG. 7, each of four inlet ports 114, 116, 118 and 120 receives adhesive for distribution between a pair of outlet passageways 122, 124, 126, 128, 130, 132 and 134. The first inlet port 114 is shown as connected to only a single outlet passageway 122, but the outlet passageway is then branched to provide a pair of passageways to spaced apart nozzles, not shown. In contrast to the embodiments described above, the column of adhesive within an outlet passageway remains in fluid communication with a second outlet passageway during adhesive cutoff periods. However, the tendency of an adhesive applicator to drool is reduced by maintaining the pair of nozzles operationally associated with each inlet port 114–120 along the same horizontal plane. For example, the nozzle associated with the outlet passageway 124 is at a height equivalent to the height of the nozzle associated with outlet passageway 126. Likewise, the nozzles associated with outlet passageways 128 and 130 are at the same height. However, of far less importance is the height of the nozzle associated with outlet passageway 124 relative to the nozzle associated with outlet passageway 128, since those two outlet passageways receive adhesive from different inlet ports and can therefore be sealed from each other during adhesive cutoff periods.

Figure 8:
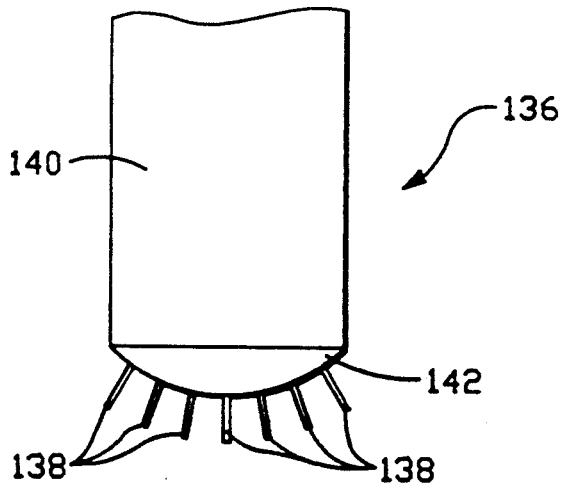
FIG. 8 is a nozzle having a plurality of outlets for use with the actuator of FIG. 4.

Referring now to FIG. 8, a single nozzle 136 is shown as extruding a number of streams 138 of adhesive. The nozzle 136 may be used with the solenoid armature 84 shown in FIG. 4. The solenoid armature is housed within a cylindrical portion 140, and the crimp ball 88 should have a geometry corresponding to an arcuate portion 142 of the nozzle. In a retracted position, the solenoid armature 84 spaces the crimp ball apart from the surface of the arcuate portion 142 of the nozzle. In this retracted position ports within the arcuate portion are in fluid communication with a source of adhesive. During cutoff periods, the solenoid armature moves downwardly into contact with the arcuate portion 142 to seal the ports and prevent flow of adhesive. Thus, the nozzle 136 replaces the manifold 10 of FIG. 1. A similar result of providing a plurality of closely spaced streams 138 of adhesive can be achieved by directing the face-plate 80 of FIG. 4 in a downward direction, so that adhesive enters the atmosphere directly from the adhesive-receiving ports 92–96.

We claim:

1. A device for applying viscous fluid material comprising, a manifold block having a feed passageway and a plurality of outlet passageways formed through said manifold block, said feed passageway having an array of inlet ports to said outlet passageways, each inlet port operatively associated with at least one outlet passageway for channeling viscous fluid material from said feed passageway, said inlet ports arranged to provide fluid communication among said outlet passageways via said feed passageway, said manifold block having a lower surface varying in distance relative to the horizontal, a carton positioned below said manifold block, a plurality of nozzle means at said lower surface of said manifold block for directing said viscous fluid material from said outlet passageways downwardly onto said carton, said nozzle means having varying heights relative to the horizontal, and drool-retarding means for selectively segregating said outlet passageways with respect to fluid communication among said outlet passageways, said drool-retarding means including a reciprocating member having an inoperative position in which a plurality of said inlet ports are sealed and having a fluid-apply position in which said inlet ports are free to allow said fluid communication among said outlet passageways, thereby inhibiting gravity feed of viscous fluid material from one outlet passageway into other outlet passageways.

2. The device of claim 1 wherein said manifold means includes a valve seat area having said inlet ports arranged therein, said reciprocating member selectively contacting said valve seat area to block said inlet ports.

3. The device of claim 2 wherein said reciprocating member has an arcuate surface and said valve seat has a curvature generally corresponding to the shape of said arcuate surface.

4. The device of claim 1 wherein said inlet ports correspond in number to said outlet passageways.

5. The device of claim 1 further comprising means for biasing said reciprocating member in one of said inoperative and fluid-apply positions.

6. A device for controlling drool from adhesive-release openings of an adhesive applicator, said device being downstream of a first means for selectively regulating adhesive flow, said device comprising, a manifold having a feed passageway to receive a regulated flow of pressurized adhesive, said manifold having a valve seat having an array of inlet ports to a plurality of adhesive-release passageways, said valve seat including a seat surface having said array of inlet ports, means for selectively blocking fluid communication among said adhesive-release passageways, said blocking means including a valve member having a valve surface parallel to said seat surface, said valve member having a first position in which said valve surface is in abutting relation with said seat surface and having a second position spaced apart from said first position, said valve member covering said inlet ports when in said first position and allowing fluid communication among said inlet ports when in said second position, and biasing means for urging said valve member into said first position upon discontinuance of a flow of pressurized adhesive into said feed passageway, wherein said valve member has a stem portion having an axial bore in fluid communication with said feed passageway, said stem portion being perpendicular to said valve surface at a side of said valve surface opposite to said biasing means, said stem having an outlet channel extending from said axial bore, said outlet channel sealed from said inlet ports when said valve member is in said first position.

7. The device of claim 6 wherein said biasing means is a spring.

8. A device for controlling drool from adhesive-release openings of an adhesive applicator comprising, a source of adhesive, distribution means for releasing adhesive into the atmosphere for deposition on a substrate, said distribution means having a feed passageway connected to receive a pressurized flow of adhesive from said source, said distribution means having a valve seat having an array of adhesive-receiving ports in fluid communication with said feed passageway, said distribution means having a plurality of outlet passageways extending to openings to the atmosphere, at least some of said outlet passageways extending upwardly from said adhesive-receiving ports, and solenoid means having a reciprocating armature for selectively sealing said adhesive-receiving ports from said feed passageway, said armature having a first position in contact with said valve seat to block the plurality of said adhesive-receiving ports, said armature having a second position spaced apart from said valve seat to allow fluid communication among said adhesive-receiving ports.

9. The device of claim 8 wherein said armature is a magnetically-controlled armature.

10. The device of claim 8 wherein said distribution means is a manifold having a lower surface having a Y-shape, said manifold having plurality of nozzles in fluid communication with said adhesive-receiving ports via said outlet passageways.

11. The device of claim 8 wherein said solenoid means includes a biasing means for urging said armature into said first position.

12. The device of claim 8 wherein said adhesive-receiving ports are at least six in number.

13. The device of claim 8 wherein said armature and said feed passageway are coaxial.

* * * * *